US010568469B1

(12) United States Patent
Kidd

(10) Patent No.: US 10,568,469 B1
(45) Date of Patent: Feb. 25, 2020

(54) CLEANING DEVICE AND METHOD OF USE

(71) Applicant: Kyndal Kidd, Odessa, TX (US)

(72) Inventor: Kyndal Kidd, Odessa, TX (US)

( * ) Notice: Subject to any disclaimer, the term of this patent is extended or adjusted under 35 U.S.C. 154(b) by 14 days.

(21) Appl. No.: 15/494,231

(22) Filed: Apr. 21, 2017

Related U.S. Application Data

(60) Provisional application No. 62/326,175, filed on Apr. 22, 2016.

(51) Int. Cl.
*A47K 7/03* (2006.01)

(52) U.S. Cl.
CPC ..... *A47K 7/03* (2013.01)

(58) Field of Classification Search
CPC ..... A47K 7/02; A47K 7/03
USPC ..... 401/152, 156, 183, 184, 186
See application file for complete search history.

(56) References Cited

U.S. PATENT DOCUMENTS 8,128,303 B2 * 3/2012 LaFlamme ..... A45D 34/04 401/188 R
2013/0058698 A1 * 3/2013 Hasidashvili ..... A47K 7/03 401/6

* cited by examiner

*Primary Examiner* — David J Walczak
*Assistant Examiner* — Joshua R Wiljanen
(74) *Attorney, Agent, or Firm* — Richard Eldredge

(57) ABSTRACT

A cleaning device includes an upper section having a top surface with one or more valves; a lower section; a connection to secure the upper section to the lower section; a cavity formed between the upper section and the lower section; and fabric pieces secured to and extending from the top surface; the cavity is to hold a fluid to dispense through the one or more valves; and the upper section and the lower section are composed of a pliable material.

8 Claims, 6 Drawing Sheets

CLEANING DEVICE AND METHOD OF USE

BACKGROUND

1. Field of the Invention

The present invention relates generally to a cleaning towel container and method of use.

2. Description of Related Art

Devices for cleaning a person are well known in the art. For example, FIG. 1 depicts a perspective view of a sponge 101 having a porous body 103 and a plurality of cavities 105. As depicted in FIG. 2, one of the common uses of sponge 101 is to clean the head of an infant 201. Of course, it should be understood that the sponge 101 could be utilized on various other surfaces for cleaning. The sponge 101 is an effective means to absorb water and cleaner solution for removing dirt and other debris from the surface.

One of the commonly known problems associated with sponge 101 is the inherent tendency for the sponge to collect debris, mold, cleaning solutions, and/or other unwanted substances after much use. Such features are undesired when utilizing the sponge 101 to clean sensitive surfaces such as the head of infant 201. It should be understood that sponge 101 is not washable by washing machine and/or dishwasher and is typically disposed of after much use.

Although great strides have been made in the area of cleaning devices as discussed above, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
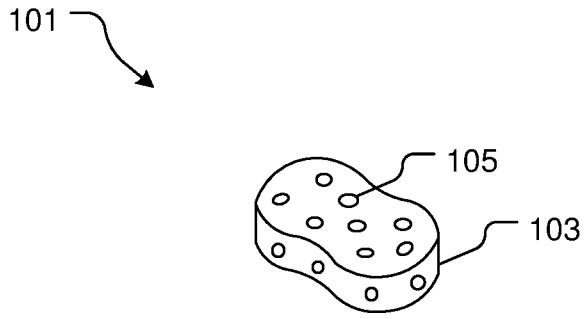
FIG. 1 (Prior Art)
FIG. 1 is an oblique view of a conventional sponge.
Figure 2:
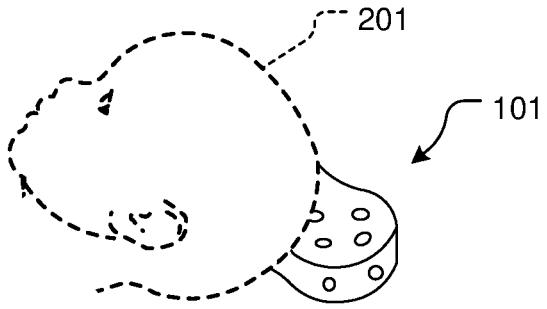
FIG. 2 (Prior Art)
FIG. 2 is an oblique view of the sponge of FIG. 1 during use.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 3A:
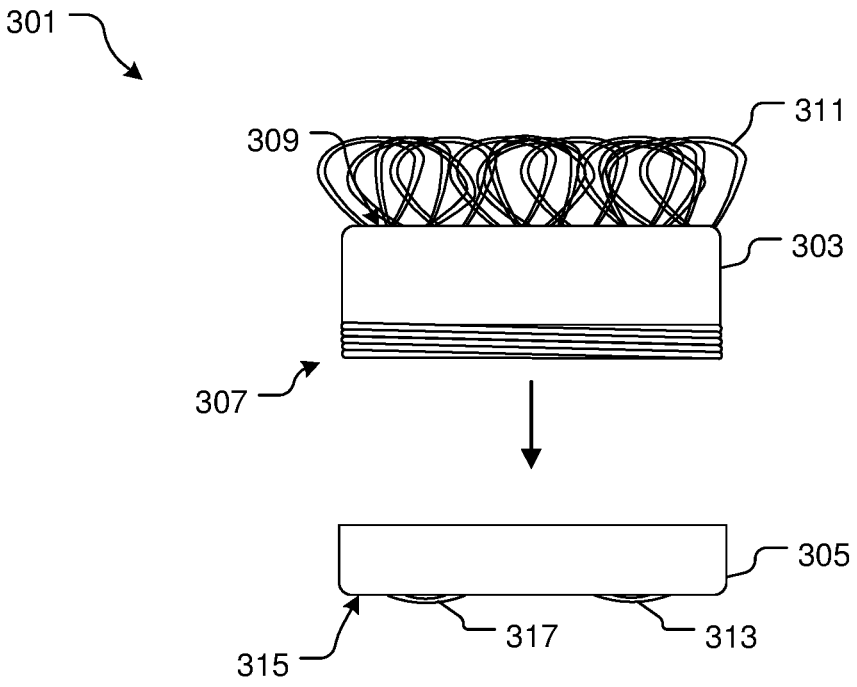
FIGS. 3A and 3B are side views of a cleaning device and method of use in accordance with a preferred embodiment of the present application.
Figure 3B:
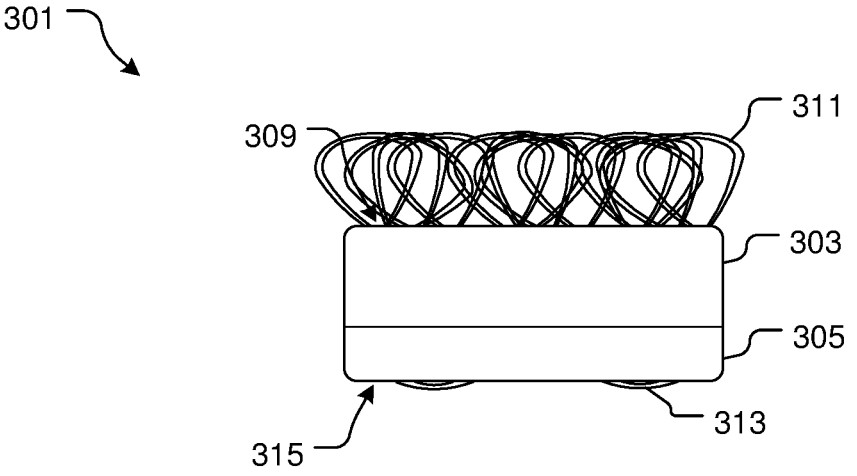
Figure 4:
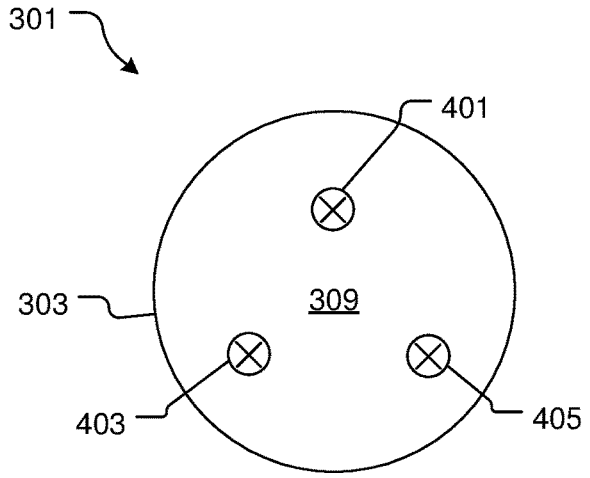
FIG. 4 is a top view of the upper section of the cleaning device of FIG. 3A.
Figure 5:
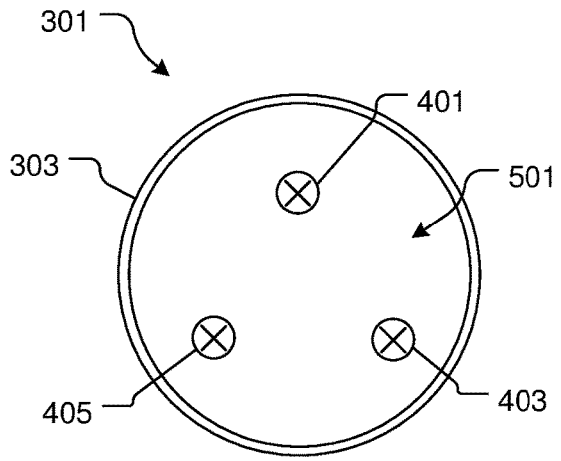
FIG. 5 is a bottom view of the upper section of the cleaning device of FIG. 3A.
Figure 6:
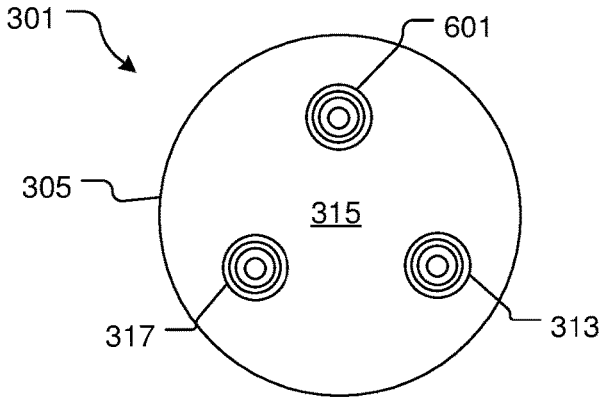
FIG. 6 is a top view of the lower section of the cleaning device of FIG. 3A.
Figure 7:
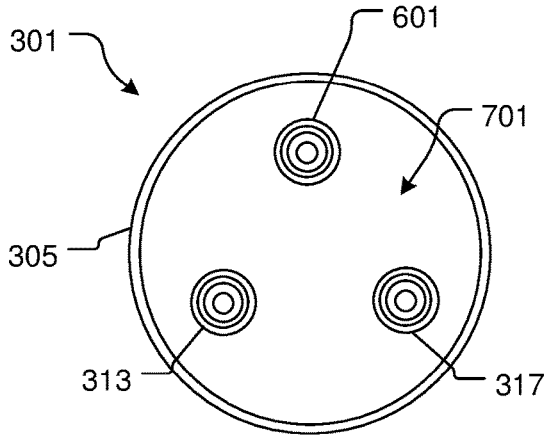
FIG. 7 is a bottom view of the lower section of the cleaning device of FIG. 3A.
Figure 8A:
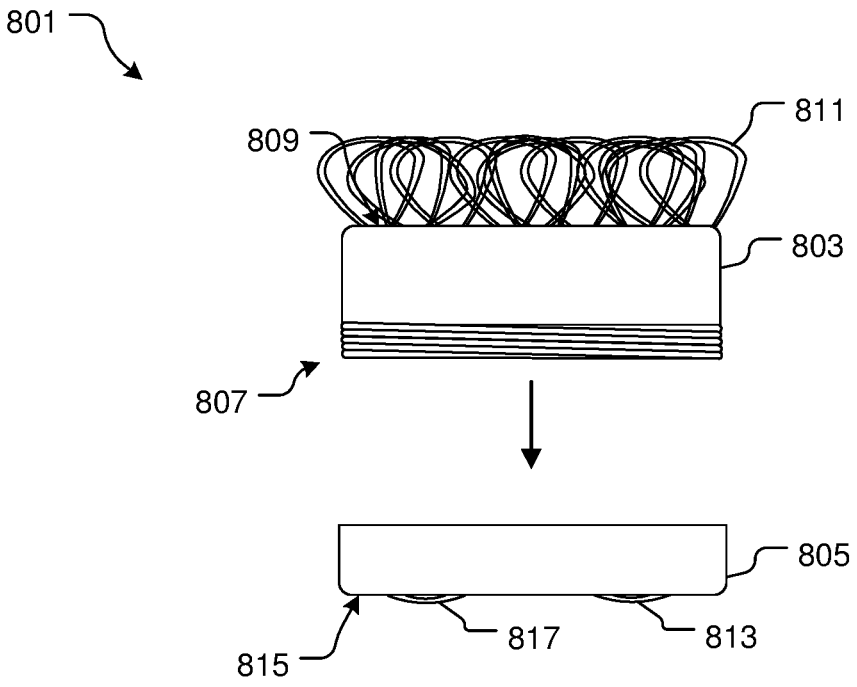
FIGS. 8A and 8B are side views of a cleaning device and method of use in accordance with an alternative embodiment of the present application.
Figure 8B:
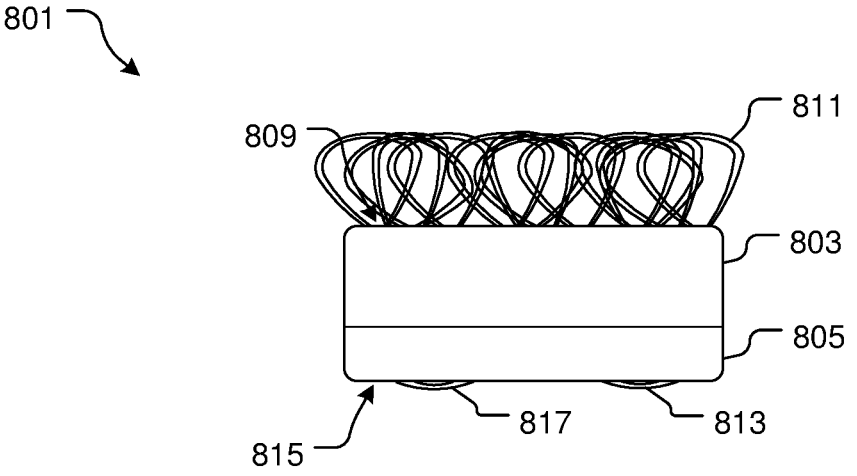
Figure 9:
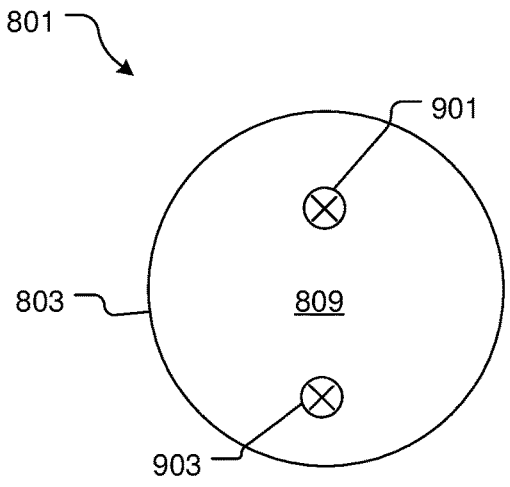
FIG. 9 is a top view of the upper section of the cleaning device of FIG. 8A.
Figure 10:
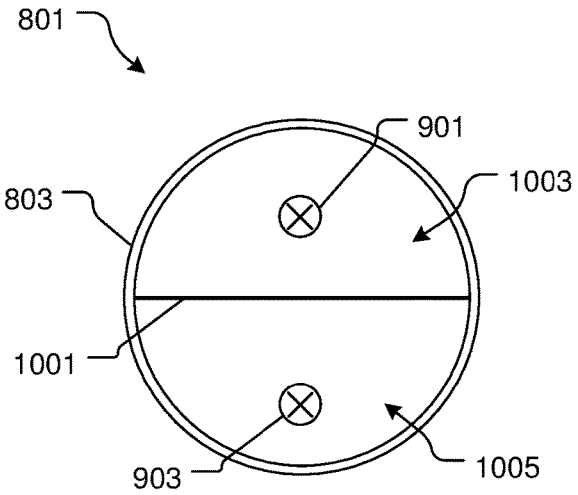
FIG. 10 is a bottom view of the upper section of the cleaning device of FIG. 8A.
Figure 11:
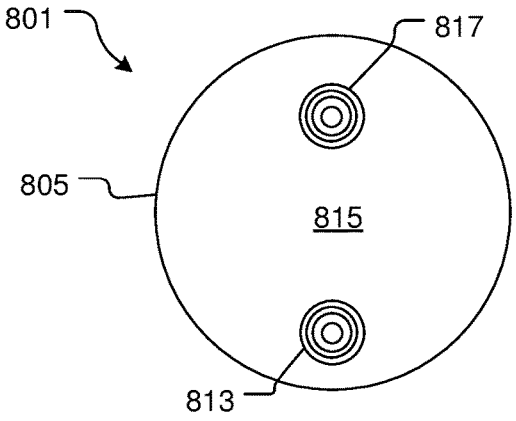
FIG. 11 is a top view of the lower section of the cleaning device of FIG. 8A.
Figure 12:
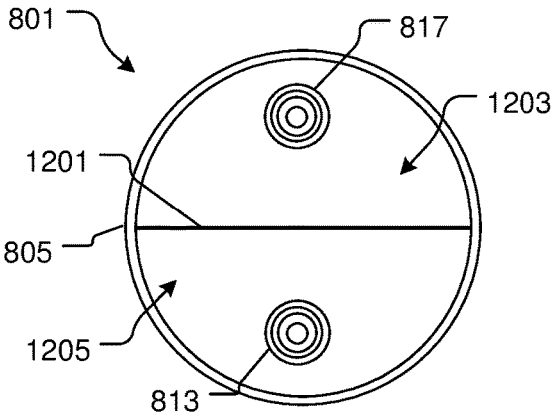
FIG. 12 is a bottom view of the lower section of the cleaning device of FIG. 8A.

Referring now to the drawings wherein like reference characters identify corresponding or similar elements throughout the several views, FIGS. 3A and 3B depict respective exploded and assembled side views of a cleaning device 301 in accordance with a preferred embodiment of the present application. It will be appreciated that cleaning device 301 overcomes one or more of the above-listed problems commonly associated with the conventional cleaning devices such as sponges.

In the contemplated embodiment, cleaning device 301 includes one or more of upper section 303 adapted to threadedly engage with a lower section 305 via threaded section 307. When assembled, the plurality of threads from the upper section 303 engage with threads of the lower section 305 as shown in FIG. 3B. The upper section 303 and the lower section 305 are preferably composed of a pliable material, such as silicone or rubber, that conforms to the surface placed thereon, e.g., the contouring of the infant head. The upper section and the lower section are also preferably composed of a material that is dishwasher and laundry washer safe.

In the preferred embodiment, the two sections 303, 305 are secured together via a plurality of threads; however, it will be appreciated that other contemplated embodiments could include other fastening means to secure the sections together.

The upper section 303 includes a top surface 309 wherein a plurality of looped fabric towels 311 extend therefrom. During use, the looped fabric towels 311 are configured to clean the surface rubbed thereagainst. The fabric towels are pliable and conform the surface contouring placed thereon.

One of the unique features believed characteristic of the present invention is the use of looped fabric towels to clean the surface placed thereon. The towels are washable and are less likely to retain debris, soap, cleaning solution, and other unwanted substances. After use, the device 301 can be readily and easily washed in the washing machine and/or dish washer.

The lower section has a bottom surface 315 wherein one or more pressure mounds 313, 317, 601 extend therefrom. During use, the pressure mounds create a pressure force within the cavity 501, which in turn causes the fluid carried therein to exit one or more valves 401, 403, 405 extend through upper section 303. These features are shown in FIG. 4-7 of the drawings. It should be understood that FIG. 4 does not show the towels 311 so that the valves 401, 403, 405 can easily be shown.

The preferred embodiment includes a single fluid chamber 501 wherein cleaning fluid is stored. Accordingly, the cleaning device 301 is configured to store cleaning fluid within the cavities 501, 701 created by respective upper section 303 and lower section 305 and sealed via the threaded section 307.

It will be appreciated that alternative embodiments could include multiple cavities fluidly separated from each other. Such features are shown in the alternative embodiment of FIGS. 8A-12.

Cleaning device 801 is substantially similar in form and function to device 301 and incorporates the features discussed herein. However, the cleaning device of the contemplated embodiments forms two fluidly separated cavities that allows the user to utilize different types of cleaning solutions and/or other types of liquid. This feature provides advantages such as enabling the user to carry shampoo in one cavity and body wash in another cavity.

Device 801 includes an upper section 803 threadedly engaged with a lower section 805 via a threaded section 807. A plurality of towels 811 extend from a top surface 809 and pressure mounds 813, 817 extend from a bottom surface 815.

In the exemplary embodiment, valves 901, 903 extend through surface 809 and provide fluid communication with respective cavities 1003, 1005, which in turn are fluidly separated via a partition 1001. The lower section 805 forms a first cavity 1203 and a second cavity 1205 fluidly separated via a partition 1201. The pressure mounds 817, 813 are in communication with respective cavities 1203, 1205. During use, pressure on mound 817 causes the cleaning fluid disposed within cavities 1203, 1003 to pass through valve 901. Likewise, pressure on mound 813 causes the cleaning fluid disposed within cavities 1205, 1005 to pass through valve 903.

It should be understood that partitions 1001, 1201 align with each other on a common plane as upper section 803 is secured to lower section 805. This feature enables the opposing cavities to remain fluidly separated from each other.

Figure 13:
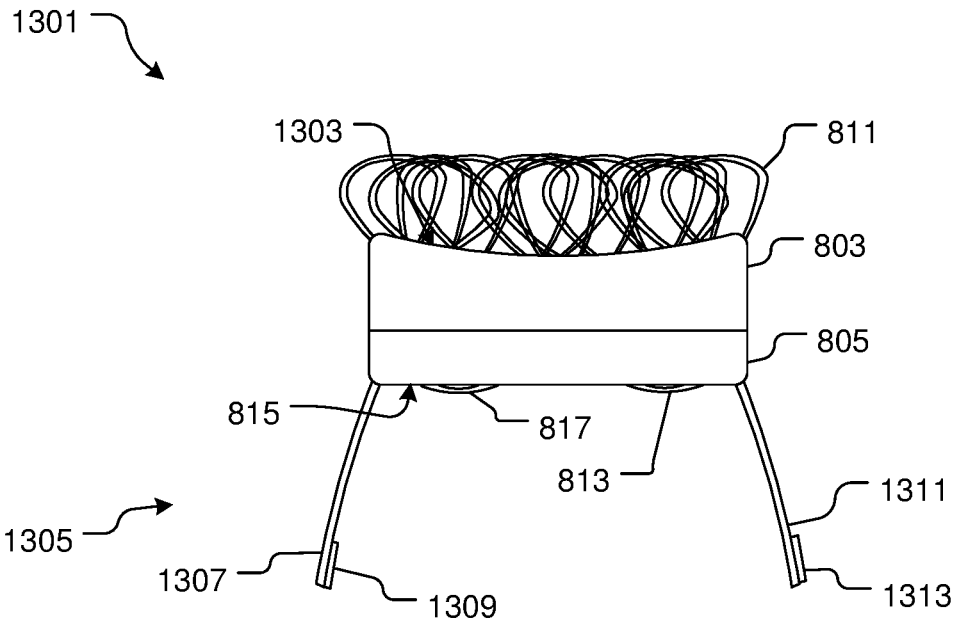
FIG. 13 is a side view of a cleaning device and method of use in accordance with an alternative embodiment of the present application.

Referring now to FIG. 13, an alternative embodiment of the cleaning devices discussed above is shown. The cleaning device 1301 includes the features of cleaning device 801 and is further provided with a contoured top surface 1303. This feature allows the user to better secure the head of the infant during use. The cleaning device is further provided with an attachment assembly 1305 having a first strap 1307 with a first fastener 1309 and a second strap 1311 with a second fastener 1313. During use, the straps 1307, 1311 extend over the hand of the user and the fasteners 1309, 1313 are configured to engage with each other.

Figure 14:
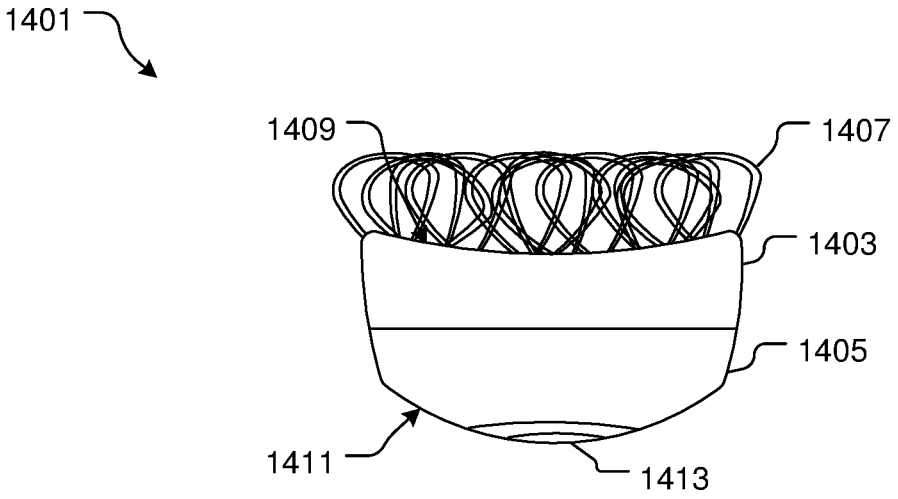
FIG. 14 is a side view of a cleaning device and method of use in accordance with an alternative embodiment of the present application.

An alternative embodiment of the cleaning device is shown in FIG. 14. Cleaning device 1401 is substantially similar in form and function to one or more of the cleaning devices discussed above and incorporates the features discussed herein. However, the cleaning device 1401 of the contemplated embodiment includes a contoured lower section with an integral pressure mound.

Device 1401 includes an upper section 1403 threadedly engaged with a lower section 1405 via a threaded section. A plurality of towels 1407 extend from a contoured top surface 1409. The lower section 1405 includes a contoured bottom surface 1411 intended to fit within the palm of the user and includes a pressure mound 1413 integral with the bottom surface 1411. During use, the user can squeeze the pressure mound with the palm of the hand and the liquid disposed within the fluid cavity exits through one or more valves, as illustrated in the previously discussed alternative embodiments of the cleaning devices.

It should be appreciated that the plurality of fabric loops can alternatively be strips or any other cut of material capable of providing a cleaning surface.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A cleaning device, comprising:

an upper section having a top surface with a first valve and a second valve;

a lower section;

a connection configured to secure the upper section to the lower section;

a cavity formed between the upper section and the lower section;

a plurality of fabric pieces secured to and extending from the top surface;

a first partition secured within an interior of the upper section; and a second partition secured within an interior of the lower section;

wherein the first partition and the second partition align when the upper section is secured to the lower section; and wherein the first partition and the second partition separate the cavity into a first section and a second section, the first section is fluid separably from the second section, the first section in fluid communication with the first valve, the second section in fluid communication with the second valve;

wherein the cavity is configured to hold a first fluid in the first section and configured to dispense through the first valve and to hold a second fluid different from the first fluid and to dispense the second fluid through the second valve; and wherein the upper section and the lower section are composed of a pliable material.

2. The device of claim 1, wherein the pliable material is silicone.

3. The device of claim 1, wherein the pliable material is rubber.

4. The device of claim 1, further comprising:

one or more pressure mounds extending from a bottom surface of the lower section;

wherein pressure on a first pressure mound of the one or more pressure mounds forces the first fluid through the first valve and pressure on a second mount of one or more pressure mounds forces the second fluid through the second valve.

5. The device of claim 1, wherein the top surface is concave.

6. The device of claim 1, wherein the lower section further comprises:

a convex bottom surface; and a pressure mound integral with the lower section;

wherein pressure on the pressure mound forces the fluid through the one or more valves.

7. The device of claim 1, further comprising:

an attachment assembly secured to a bottom surface of the lower section;

wherein the attachment assembly is configured to secure the cleaning device of a user's hand.

8. The device of claim 7, wherein the attachment assembly comprises:

a first strap; and a second strap;

wherein the first and second strap secure around the user's hand.

* * * * *